US007506826B2

(12) United States Patent
Miller

(10) Patent No.: US 7,506,826 B2
(45) Date of Patent: Mar. 24, 2009

(54) INJECTION VALVE WITH A CORROSION-INHIBITING, WEAR-RESISTANT COATING AND METHOD FOR THE PRODUCTION THEREOF

(75) Inventor: Frank Miller, Ilsfeld (DE)

(73) Assignee: Robert Bosch GmbH, Stuttgart (DE)

( * ) Notice: Subject to any disclaimer, the term of this patent is extended or adjusted under 35 U.S.C. 154(b) by 480 days.

(21) Appl. No.: 10/530,316

(22) PCT Filed: Sep. 3, 2003

(86) PCT No.: PCT/DE03/02919

§ 371 (c)(1), (2), (4) Date: Mar. 1, 2006

(87) PCT Pub. No.: WO2004/033895

PCT Pub. Date: Apr. 22, 2004

(65) Prior Publication Data

US 2006/0202049 A1 Sep. 14, 2006

(30) Foreign Application Priority Data

Oct. 4, 2002 (DE) ..... 102 46 230

(51) Int. Cl.
*F02M 51/00* (2006.01)

(52) U.S. Cl. ..... 239/585.1; 239/596; 239/900; 239/DIG. 4

(58) Field of Classification Search ..... 239/5, 239/584, 585.1, 585.4, 900, DIG. 19, 596, 239/DIG. 4; 427/249.15
See application file for complete search history.

(56) References Cited

U.S. PATENT DOCUMENTS

| | | | | |
|---|---|---|---|---|
| 5,012,982 | A * | 5/1991 | Souma et al. | 239/900 |
| 5,336,320 | A * | 8/1994 | Hogan et al. | 239/584 |
| 5,783,261 | A * | 7/1998 | Potter et al. | 427/249.15 |
| 6,145,763 | A * | 11/2000 | Fleming et al. | 239/585.1 |
| 6,508,416 | B1 * | 1/2003 | Mastro et al. | 239/585.1 |

FOREIGN PATENT DOCUMENTS

| | | |
|---|---|---|
| DE | 37 01 989 | 7/1987 |
| DE | 37 16 072 | 12/1987 |
| DE | 37 16 073 | 4/1988 |
| DE | 692 12 609 | 3/1997 |
| DE | 196 26 576 | 1/1998 |
| DE | 199 30 312 | 2/2001 |
| DE | 199 53 803 | 5/2001 |
| DE | 100 02 004 | 8/2001 |
| DE | 101 12 149 | 11/2001 |
| DE | 100 38 954 | 2/2002 |
| DE | 696 15 942 | 6/2002 |
| DE | 697 09 375 | 8/2002 |
| EP | 1 150 004 | 10/2001 |
| JP | 62 020 672 | 1/1987 |

* cited by examiner

*Primary Examiner*—Steven J Ganey
(74) *Attorney, Agent, or Firm*—Kenyon & Kenyon LLP

(57) ABSTRACT

A fuel injector for injecting water, in particular into the gas flow of fuel cells, has a valve needle having joined to its spray-discharge end a valve-closure member, which cooperates with a valve-seat surface formed on a valve-closure member a sealing seat. A spray-discharge orifice is provided downstream from the sealing seat, at least a portion of the surfaces of the fuel injector that come into contact with water being coated by a corrosion-inhibiting and/or friction-reducing coating.

10 Claims, 3 Drawing Sheets

INJECTION VALVE WITH A CORROSION-INHIBITING, WEAR-RESISTANT COATING AND METHOD FOR THE PRODUCTION THEREOF

FIELD OF THE INVENTION

The present invention relates to a fuel injector and to a method for manufacturing a fuel injector.

BACKGROUND INFORMATION

In fuel cells as they are commonly used in motor vehicles, in particular in the case of fuel cells having a proton-conducting polymer membrane, which are also known under the English term of proton exchange membrane fuel cell (PEM-FC) or polymer electrolyte fuel cell, the membrane forming the electrolyte must be kept moist at all times during operation. If the moisture drops below a certain value, the ion conductivity of the membrane decreases. To keep the moisture of the fuel cell membrane at a specific optimum level, deionized water is often metered to the supplied gas flow.

The German Published Patent Application No. 199 53 803 describes a device for moistening the gas flow where water is added to the gas flow via a simple nozzle that projects into the gas flow.

However, the water should be metered into the gas flow as precisely as possible as a function of the gas flow across a broad dosing range, largely independently of the water-pump pressure, and it should be able to be regulated across a plurality of parameters in a cost-effective and reliable manner. For these reasons, the use of fuel injectors, for instance, which are already known from reciprocating engines having internal combustion, is advantageous for the metering of water. Such a valve is known from German Published Patent Application No. 199 53 803, for example.

A similar type of application is the precise metering of a watery urea-water solution to reduce the nitrogen oxides in the exhaust tract of diesel vehicles for exhaust-gas aftertreatment or in the case of generally non-lubricatable media.

For the system known from German Published Patent Application No. 199 53 803, disadvantages result that are mainly due to the fact that the device disclosed there has been optimized for the processing of fuels, which have considerably different chemical properties than water. For instance, most fuels such as gasoline have their own lubrication characteristics and have an inhibiting effect on chemical corrosion or do not promote chemical corrosion by themselves, in particular on metallic surfaces. Water, on the other hand, has no intrinsic lubricating characteristics and promotes chemical corrosion on metallic surfaces, in particular on metal surfaces containing iron. In the fuel injector mentioned, such iron-containing metallic surfaces are quite frequently in contact with the particular fluid to be injected.

It is also disadvantageous that the known fuel injector is designed for use in higher temperature ranges such as above 100° C. For that reason, metallic materials, which have excellent thermal resistance, were used in the valve-sealing seat in the manufacture of the fuel injector. However, the use of thermally resistant material such as iron-containing metal in the region of the sealing seat allows only a certain measure of tightness of the sealing seat, even when cost-intensive small manufacturing tolerances are used. Furthermore, due to their lack of elasticity, thermally resistant metals increase the forces acting in the sealing seat or in the force-transmitting components during the valve opening and closing operations.

SUMMARY OF THE INVENTION

In contrast, the fuel injector according to the present invention has several advantages over the related art. For instance, the surfaces in contact with water, which are provided with a corrosion-inhibiting or friction-reducing coating, are protected from chemical or mechanical corrosion, in particular chemical corrosion and frictional wear, in an effective and long-lasting manner.

It is particularly advantageous if the corrosion-inhibiting and/or friction-reducing coating is made up of a plurality of layers or coats. In this way, the characteristics of several coating materials may be combined. For instance, a watertight bottom layer that adheres well to metal, may be combined with a friction-reducing top layer in this manner.

If the fuel injector has a swirl-generating device, the water may be injected into the gas flow with an angular momentum. This distributes the injected water in the gas flow in a more optimal manner.

If the joints, in particular the welded seams that are in contact with the water, are advantageously coated by the corrosion-inhibiting or friction-reducing layer, this will also contribute to a longer service life and improved reliability of the fuel injector. Coating the guide and gliding surfaces of the fuel injector that come into contact with water results in a particularly long service life and high reliability as well.

Due to the application of the corrosion-inhibiting or friction-reducing coating with the aid of a galvanic, physical or chemical method, it is possible to take the different properties of the coating material and surface to be coated into account. In the same way, it is possible to consider the different properties of the material to be coated or the intended properties of the coated surface via the selection of the material forming the corrosion-inhibiting or friction-reducing layer.

It is possible to increase the tightness of the sealing seat without having to revert to smaller and more cost-intensive manufacturing tolerances. Because of the elastic sealing ring, the components disposed in the sealing seat or in operative connection therewith are subjected to less force. This increases the service life and reliability of the fuel injector. It is particularly advantageous to use a sealing ring here that is at least partially made of an elastomeric material.

The method according to the present invention has the advantage of allowing the simple and thus cost-effective manufacture of a fuel injector by which the mentioned advantages may be achieved.

Since the components are joined by welding or soldering, especially cost-effective and reliable joints are obtained. It is particularly advantageous if the material forming the corrosion-inhibiting or friction-reducing coating is fed to the location to be coated by means of a canula. In this way, the apportioning may be implemented with particular precision, in a material-saving and thus cost-effective manner.

The aftertreatment in the form of a centrifugation of the joined components provides for an especially complete coating, since in particular the material forming the coating is then able to penetrate the tiniest gaps, for instance of the welded joint. Due to the thermal treatment the corrosion-inhibiting or friction-reducing layer is joined to the particular surface in an especially effective and durable manner.

DETAILED DESCRIPTION

Figure 1:
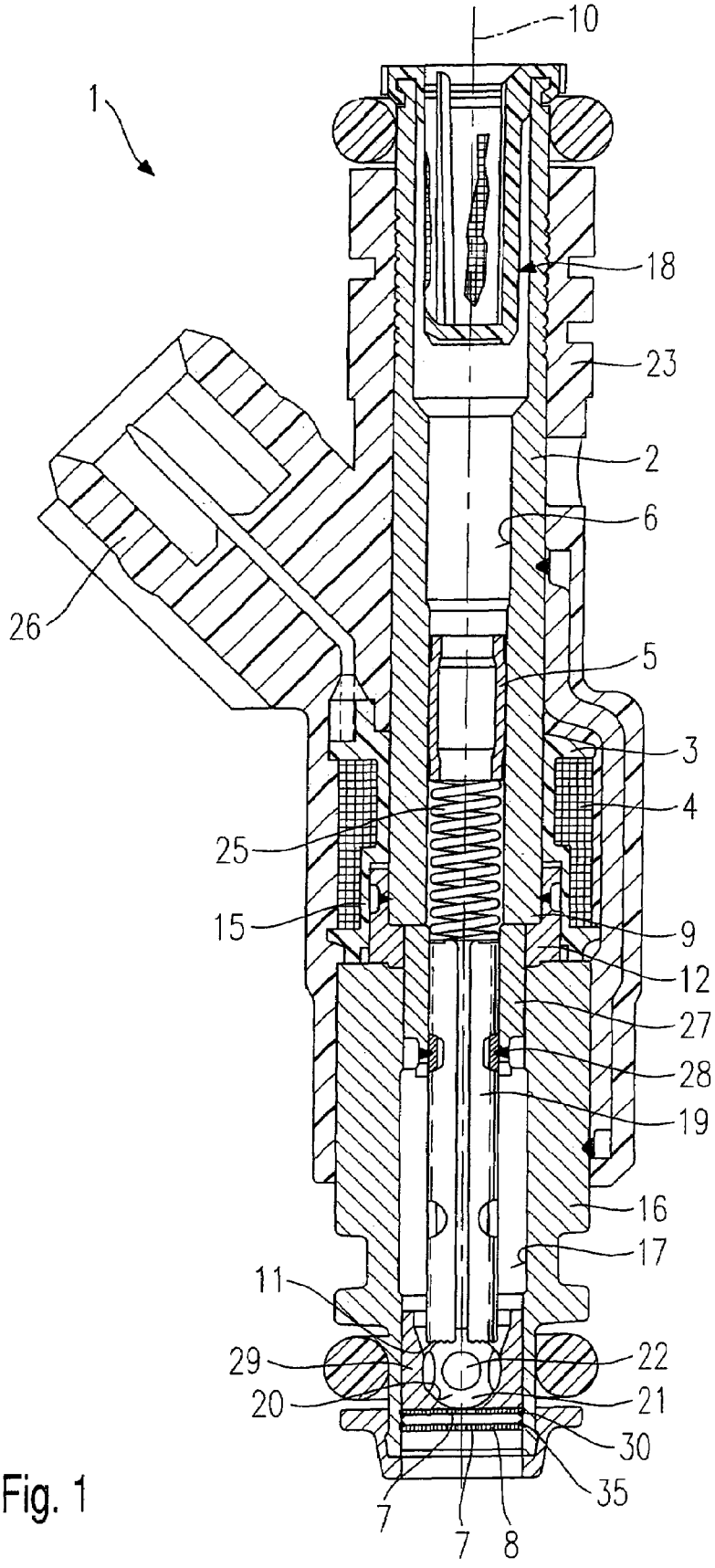
FIG. 1 shows a schematic section through an exemplary embodiment of a fuel injector according to the present invention.

In the following, exemplary embodiments of the present invention are described by way of example. Identical parts have been provided with matching reference numerals in all of the figures.

Figure 3:
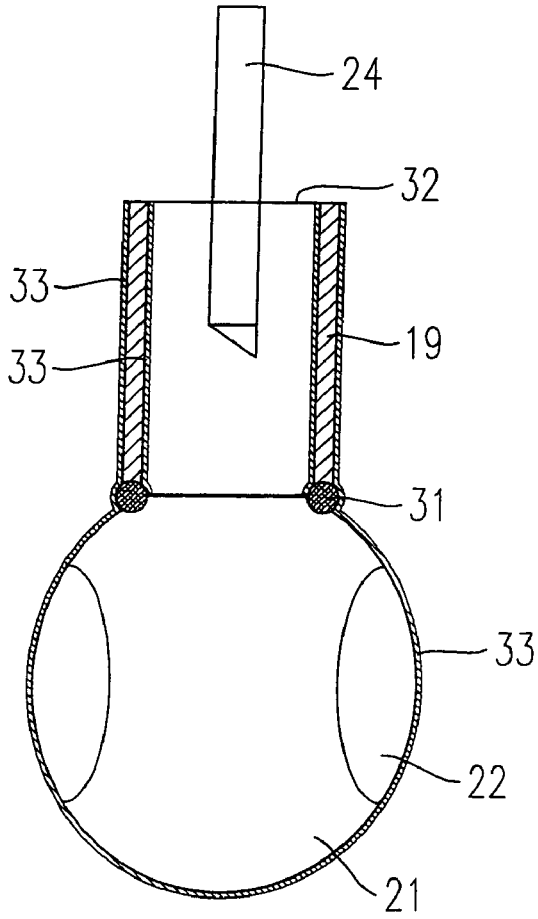
FIG. 3 shows a schematic partial section through a valve-closure member and a valve needle having a positioned canula.

A fuel injector 1 shown in FIG. 1 is used, in particular, for the injection of water into the gas flow of a fuel cell (not shown further). Fuel injector 1 includes a core 2, which is used as intake nipple and is surrounded by a solenoid coil 4, core 2 being configured in the shape of a tube in this case and having a constant outer diameter over its entire length. However, it may also have a graded design. A coil shell 3 graded in the radial direction accommodates a winding of solenoid coil 4 and, in conjunction with core 2 having a constant outer diameter, enables fuel injector 1 to have an especially compact design in the region of solenoid coil 4. A tubular, metal intermediate part 12 is connected to a lower core end 9 of core 2, e.g. by welding, so as to form a seal and be concentric to a longitudinal valve axis 10, the intermediate part partially surrounding core end 9 in an axial manner. Graded coil shell 3 partially covers core 2, and its step 15 having a greater diameter axially covers at least a portion of intermediate part 12. A tubular nozzle body 16, which is rigidly connected to intermediate part 12, for instance, extends downstream from coil shell 3 and intermediate part 12. A longitudinal bore 17, which is concentric to longitudinal valve axis 10, runs in nozzle body 16. Arranged in longitudinal bore 17 is a valve needle 19 having a tubular design, for instance, which, by means of at least one third welded seem 31 shown in FIG. 3, is joined at its downstream end to a spherical valve-closure member 21 at whose circumference five flattened regions 22, for instance, are provided.

Fuel injector 1 is activated in the known manner, in this exemplary embodiment, electromagnetically. For the axial displacement of valve needle 19, and thus for the opening counter to the spring force of a restoring spring 25, or for the closing of fuel injector 1, the electromagnetic circuit having solenoid coil 4, core 2 and an armature 27 is utilized. Hollow-cylindrical armature 27 encloses the upstream end of valve needle 19 and is connected to it in force-locking manner by a first welded seam 28. Sealingly installed in longitudinal bore 17 in the downstream end of nozzle body 16 and facing away from core 2, using a second welded seam 30, is a cylindrical valve-seat member 29 having a valve seat surface 20. Valve-closure member 21 cooperates with valve-seat surface 20, formed on valve seat member 29, to a sealing seat.

A guide opening 11 of valve-seat member 29 guides valve-closure member 21 during the axial displacement of valve needle 19 with armature 27 along longitudinal valve axis 10. At its front end facing away from valve-closure member 21, nozzle body 16 is concentrically and firmly joined by means of a fourth welded seam 34 to a spray-orifice plate 8, which may have a cup-shaped design, for instance. Spray-orifice plate 8 has at least one, but in this case, four spray-discharge orifices 7 for the spray-discharging of water or de-ionized water into a gas flow of a fuel cell (not shown).

According to the present invention, welded seams 28, 30, 31, 34 are coated by a corrosion-inhibiting and/or friction-reducing layer.

The insertion depth of valve-seat member 29 having cup-shaped spray-orifice plate 8 determines the pre-adjustment of the lift of valve needle 19. In the case of a non-energized solenoid coil 1, the one end position of valve needle 19 is determined by the contact of valve-closure body 21, while in the case of an energized solenoid coil 4 the other end position of valve needle 19 results from the contact of armature 27 with core end 9.

An adjustment sleeve 5, which is inserted into a flow bore 6 of core 2 running concentrically to longitudinal valve axis 10, and which may be formed from rolled spring steel or a copper alloy, for example, is used to adjust the initial spring tension of restoring spring 25 resting against adjustment sleeve 5, and whose opposite side is in turn braced against valve needle 19.

Fuel injector 1 is for the most part enveloped by a plastic extrusion coat 23, which extends from core 2 in the axial direction across solenoid coil 4 up to nozzle body 16. Part of this plastic extrusion coat 23 is a likewise extruded connection plug 26, for instance.

A filter 18 projects into the upstream end of flow bore 6 of core 2 and ensures that particles that would lead to interruptions of or damage to fuel injector 1 are filtered out.

At least a portion of the surfaces of fuel injector 1 coming into contact with water, in particular the inner surfaces of longitudinal bore 17, guide bore 11 and flow bore 6, as well as the surfaces of adjustment sleeve 5, valve needle 19, valve-seat surface 20 and valve-closure member 21 are coated by a corrosion-inhibiting and/or friction-reducing coating 33 (in FIG. 3).

Figure 2:
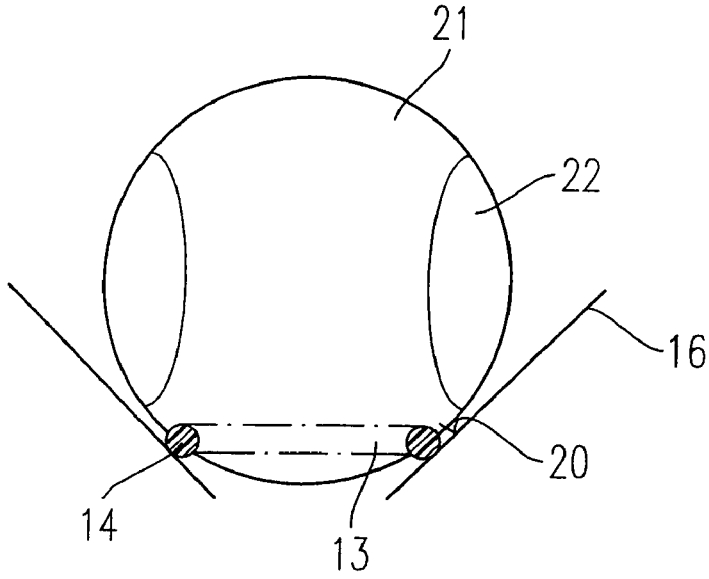
FIG. 2 shows a schematic partial section of another exemplary embodiment of a fuel injector configured according to the present invention, in the region of the valve-seat member, which is similar to the exemplary embodiment of FIG. 1, but includes an elastic sealing ring in the valve-closure member.

FIG. 2 shows a schematic part-section of another exemplary embodiment according to the present invention in the region of valve-closure member 21. Valve-closure member 21 having flattened areas 22 rests sealingly on valve-seat surface 20 of valve-seat member 29, via an elastic sealing ring 14, which is disposed in a groove 13 that is partially introduced in the lower spray-discharge side region of valve-closure member 21 in an annular manner. As an alternative or in addition to elastic sealing ring 14 partially introduced in groove 13, it is possible to coat valve-seat surface 20 and/or valve-closure member 21 with a corrosion-inhibiting or wear-reducing coating (33 in FIG. 3), in particular for the damping of forces occurring in the valve actuation, and thus for the long-term sealing when fuel injector 1 is closed.

FIG. 3 shows a canula 24 that is part of a metering device, which is not shown further. Canula 24 is beveled at its end facing valve-closure member 21. According to a preferred method of the present invention, the metering device engages with the components joined and positioned by third welded seam 31. In the position shown, the metering of the material of corrosion-inhibiting and/or friction-reducing coating 33 would occur in the inner region of valve needle 19 and valve-closure member 21. For improved distribution of the material, canula 24 or the components are able to be rotated about their longitudinal axis. In the external region, coating 33 is applied from the outside.

Figure 4:
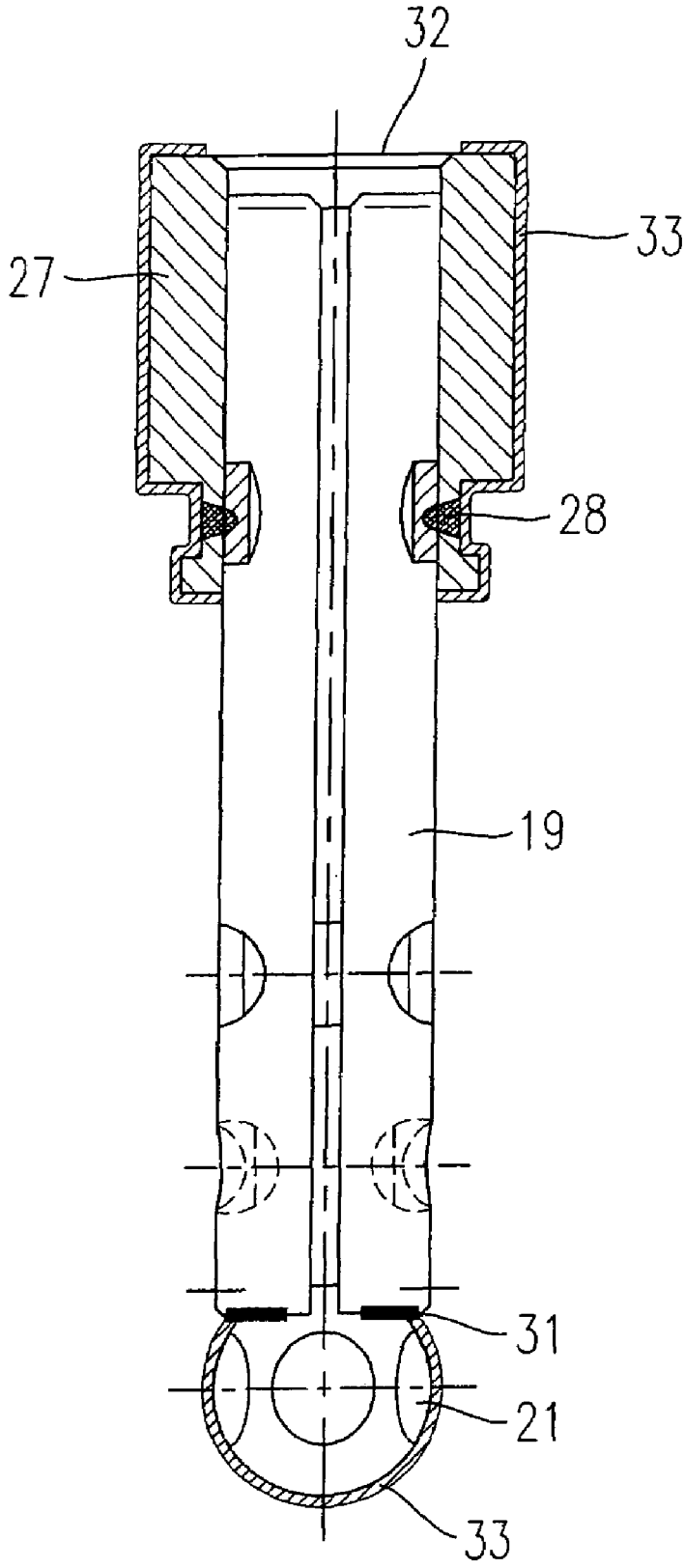
FIG. 4 shows a schematic partial section of another exemplary embodiment in the region of the valve needle, the valve-closure member and the armature.

FIG. 4 shows a schematic part-section of another exemplary embodiment in the region of valve needle 19, valve-closure member 21 and armature 27. Armature 27, first welded seam 28, third welded seam 31 and valve-closure member 21 are coated by coating 33. Valve needle 19 is made of a corrosion-resistant material such as stainless steel, although valve needle 19 may also be coated by coating 33.

Corrosion-inhibiting and/or friction-reducing coating 33 is applied with the aid of a galvanic method, for instance, but other physical or chemical methods, in particular a physical vapor deposition method or a chemical vapor deposition method, for example, are suitable as well to apply coating 33. Corrosion-inhibiting and/or friction-reducing coating 33 is made of lubricating varnish on Teflon basis, sulphur-based materials, in particular molybdenum sulphite $MOS_2$, carbon, xylan, titanium nitride TiN and/or of carbon mixtures, in particular PTEE.

Coating 33, which protects valve needle 19 and valve-closure member 21, are centrifugated during the manufacturing process, for example after the materials forming coating 33 have been applied, valve needle 19 and valve-closure member 21 having already been joined. Valve needle 19 lies on the inside during centrifugation and valve-closure member 21 lies on the outside. This makes it possible to produce a very uniform coating 33.

The present invention is not restricted to the exemplary embodiment shown, but, for instance, is also applicable to various other designs of fuel injector 1, for instance, in particular also for outwardly opening fuel injectors or for fuel injectors having piezoelectric, magnetostrictive or electrostrictive actuators. It is particularly suited for the injection of water only, in particular aggressive de-ionized water.

What is claimed is:

1. A fuel injector for injecting water, comprising:

a valve needle;

a valve-seat surface formed on a valve-seat member of a scaling seat;

a valve-closure member located at a spray-discharge-side end of the valve needle, the valve-closure member cooperating with the valve-seat surface;

a structure including at least one spray-discharge orifice provided downstream from the sealing seat, wherein at least a portion of surfaces of the fuel injector that come into contact with water are coated by a coating that is at least one of corrosion-inhibiting and friction-reducing; and an annular elastic sealing ring, wherein:

the valve-closure member includes a spherical valve-closure member, the valve-closure member includes an annular groove in a region of the sealing seat, and the annular elastic sealing ring is introduced in the annular groove.

2. The fuel injector as recited in claim 1, wherein the fuel injector injects water into a gas flow of a fuel cell.

3. The fuel injector as recited in claim 1, wherein the coating includes a plurality of layers.

4. The fuel injector as recited in claim 1, further comprising: joints including welded seams that come into contact with water and are coated by the coating.

5. The fuel injector as recited in claim 1, further comprising:

a guide surface; and a sliding surface, wherein the guide surface and the sliding surface are at least partially coated by the coating.

6. The fuel injector as recited in claim 1, wherein the coating is applied according to a galvanic technique.

7. The fuel injector as recited in claim 1, wherein the coating is applied by a physical technique including a physical vapor deposition technique.

8. The fuel injector as recited in claim 1, wherein the coating is applied by a chemical technique including a chemical vapor deposition technique.

9. The fuel injector as recited in claim 1, wherein: the coating is made of lubricating varnish on Teflon basis, from materials on sulphur basis, including molybden sulphide MOS.sub.2, of at least one of carbon, xylan, titanium nitride TiN, and carbon mixtures, including PTEE.

10. The fuel injector as recited in claim 1, wherein:

the annular sealing ring includes an elastomer.

* * * * *